US007545089B1

(12) United States Patent
Falce et al.

(10) Patent No.: US 7,545,089 B1
(45) Date of Patent: Jun. 9, 2009

(54) SINTERED WIRE CATHODE

(75) Inventors: Louis R. Falce, San Jose, CA (US); R. Lawrence Ives, Saratoga, CA (US)

(73) Assignee: Calabazas Creek Research, Inc., San Mateo, CA (US)

( * ) Notice: Subject to any disclaimer, the term of this patent is extended or adjusted under 35 U.S.C. 154(b) by 540 days.

(21) Appl. No.: 11/085,425

(22) Filed: Mar. 21, 2005

(51) Int. Cl.
*H01J 29/04* (2006.01)
*H01J 1/20* (2006.01)

(52) U.S. Cl. ..... 313/345; 313/343; 313/336; 313/337

(58) Field of Classification Search ..... None
See application file for complete search history.

(56) References Cited

U.S. PATENT DOCUMENTS 3,284,657 A * 11/1966 Weissman ..... 313/346 R
3,477,110 A * 11/1969 Honeyball ..... 445/35
3,514,324 A * 5/1970 Koppius ..... 427/78
3,681,641 A * 8/1972 Katz ..... 313/336
4,130,233 A 12/1978 Chisholm
4,165,473 A * 8/1979 Falce ..... 313/346 R
4,379,979 A 4/1983 Thomas et al.
4,500,413 A 2/1985 Taylor et al.
4,587,455 A 5/1986 Falce et al.
4,745,326 A 5/1988 Greene et al.
5,118,317 A 6/1992 Wijnen
5,304,602 A 4/1994 Yamamoto et al.
5,318,468 A * 6/1994 Lotthammer et al. ..... 445/50
5,451,831 A * 9/1995 Lee ..... 313/346 R
5,905,937 A 5/1999 Plucknett et al.
6,130,502 A * 10/2000 Kobayashi et al. ..... 313/446
6,365,092 B1 4/2002 Backa et al.
6,425,793 B1 * 7/2002 Hasegawa et al. ..... 445/51
2002/0041140 A1 4/2002 Rho et al.
2006/0028114 A1 * 2/2006 Steenbrink et al. ..... 313/345

OTHER PUBLICATIONS

Fundamental Principles of Powder Metallurgy, WO Jones Edward Arnold Publishers 1960.

* cited by examiner

*Primary Examiner*—Sikha Roy
*Assistant Examiner*—Tracie Y Green
(74) *Attorney, Agent, or Firm*—File-EE-Patents.com; Jay A. Chesavage

(57) ABSTRACT

A porous cathode structure is fabricated from a plurality of wires which are placed in proximity to each other in elevated temperature and pressure for a sintering time. The sintering process produces the porous cathode structure which may be divided into a plurality of individual porous cathodes, one of which may be placed into a dispenser cathode support which includes a cavity for containing a work function reduction material such as BaO, CaO, and $Al_2O_3$. The work function reduction material migrates through the pores of the porous cathode from a work replenishment surface adjacent to the cavity of the dispenser cathode support to an emitting cathode surface, thereby providing a dispenser cathode which has a uniform work function and therefore a uniform electron emission.

22 Claims, 3 Drawing Sheets

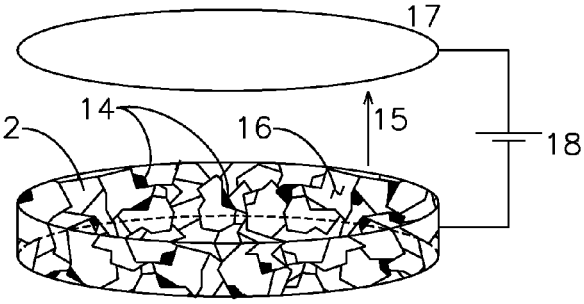
*Figure 1*
Prior Art
*Figure 2a*
Prior Art
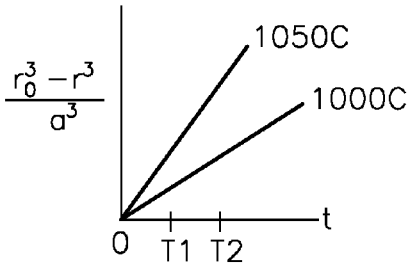
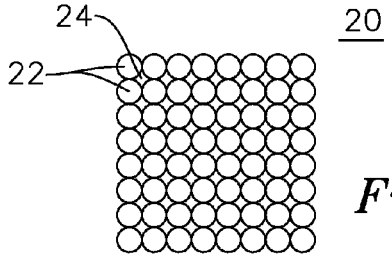
*Figure 2b*
Prior Art
t=0
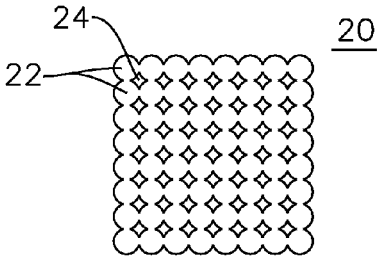
*Figure 2c*
Prior Art
t=T1
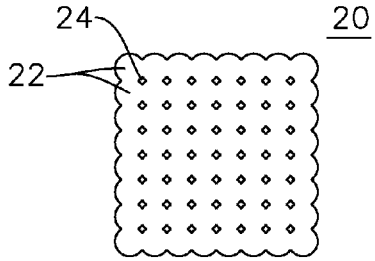
*Figure 2d*
Prior Art
t=T2

Section a–a

Section a–a

Section a–a

SINTERED WIRE CATHODE

This invention was made with United States government support under Grant DE-FG-03-04ER83918 from the United States Department of Energy. The United States Government has certain rights in this invention.

FIELD OF THE INVENTION

The present invention is related to porous cathode structures for use with microwave tubes, linear beam devices, linear accelerators, cathode ray tubes, x-ray tubes, ion lasers, and ion thrusters. More particularly, it is related to a dispenser cathode which is fabricated from a plurality of wires which are sintered into a porous cathode structure which is then parted into a porous cathode disk. The dispenser cathode is formed by bonding the porous cathode disk to a cathode enclosure proximal to both a heater and a source of work-function reducing material such as BaO, CaO, or $Al_2O_3$, which migrates through the pores of the porous cathode disk.

BACKGROUND OF THE INVENTION

In the prior art, the emitting surface of a dispenser cathode is made from either porous metal matrices whose pores are filled with electron emitting material or porous metal plugs or perforated foils covering reservoirs of electron emitting material. The porous metal matrices and porous metal plugs exhibit a random porosity without consistently uniform pore size, pore length, or spacing between the pores on the surface. The electron emission is related to the surface work function reducing material trapped in the pores, which are of variable size and spacing. Accordingly, dispenser cathodes of the prior art do not have uniform surface electron emission.

FIG. 1 shows a prior art powdered tungston sintered cathode 10. Tungsten powder grains 12 are sorted to a range on the order of 10 u and are compressed and sintered under elevated temperature to form a cathode 10 comprising a porous tungsten matrix. The matrix structure is then impregnated with a surface work function reduction material 30, such as BaO, CaO, and $Al_2O_3$. When operated as an electron source in a microwave gun, the cathode is heated to a temperature of approximately 1000° C. and a voltage 18 is applied between the cathode 16 and anode 17, which is shown as a conductive plate for simplicity. The impregnate work function reducing material (not shown) migrates through the pores 14 to the emission surface 16 and lowers the work function for electron emission, thereby improving the yield of free electrons 15. The voltage 18 is applied with sufficient potential for free electrons in the tungsten to overcome the surface work function voltage and be accelerated from the surface 16 to the anode 17. Ideally, the electron emission from cathode 16 should be uniform, however this is limited by the uniformity of deposition of work function reducing material through the cathode, which typically has irregular porosity, as was earlier described.

Others have proposed processes for manufacturing controlled porosity cathodes. In U.S. Pat. No. 4,379,979, Thomas and Green describe a technique using silicon and metal deposition. This process starts with a generally flat silicon template substrate structure having and array of upstanding microposts 1-25 microns across on 5-10 micron spacings from each other. A layer of metal is then deposited on the substrate to surround the microposts and cover the substrate to a desired depth. The metal layer is abraded to a smooth, flat surface which exposes the microposts. Thereafter, the silicon substrate and microposts are completely etched away, leaving a metal sheet having micron-size holes throughout. This technique is applicable to small, flat cathodes. It contains a number of process steps which limit both the size and configurations that can be obtained. The thickness of the cathode material is approximately 100 microns. This technique would not be applicable to large cathodes where differential thermal expansion could cause the material to buckle or warp.

In U.S. Pat. No. 4,587,455, Falce and Breeze describe a process for creating a controlled porosity dispenser cathode using laser drilling. In this process, a configured mandrel is coated with a layer of material such as tungsten so that when the mandrel is removed from the coating material a hollow housing is formed having a side wall and an end wall which define a reservoir. Thereafter an array of apertures is formed in the end wall of the housing by laser drilling to create an emitter-dispenser, but this method is only applicable to small cathodes, as the laser drilling process becomes unmanageable for large cathodes where millions of holes would be required. Also, the thin coating which forms the emitter is subject to warping and buckling from differential expansion of the coating and the support structure.

In U.S. Pat. No. 4,745,326, Green and Thomas describe a controlled porosity dispenser cathode using chemical vapor deposition and laser drilling, ion milling, or electron discharge machining for consistent and economical manufacture. This process is also more applicable for small cathodes where the number of laser drilled holes are manageable. This process also includes a large number of separate sequential processes to obtain the final cathode and can not provide cathode emitting surfaces of arbitrary thickness.

In U.S. Pat. No. 5,118,317, Wijen describes a process that uses an array of porous, sintered structures where the powder particles are coated with a thin layer of ductile material. Since this process begins with particles containing a distribution of sizes, there is no direct control of the porosity through the entire structure.

U.S. patent application No. 2002/0041140 by Rho, Cho, and Yang describes a process for oxide cathodes that controls the porosity and electron emission. This process is only applicable to oxide cathodes which are fundamentally different from the dispenser type of the present invention.

In the prior art, there is no control of the size and distribution of the pores 14 over the cathode surface 16. This results in non-uniform distribution of the work function reducing impregnate over the surface 16. In a dispenser cathode, a longer cathode lifetime is accomplished by maintaining a reservoir of work function reducing material behind a porous cathode having an emission surface, where the uniform porosity of the cathode expresses the work function reducing material to the emitting surface, resulting in a cathode with long emission times. Until the present invention, it has not been possible to fabricate a uniformly porous cathode of variable diameter or thickness for this purpose.

It is desired to provide a uniform porosity tungsten cathode which may be used as a dispenser cathode having an emission surface and a dispenser surface adjacent to a source of work function reducing material. It is also desired to provide a method for the fabrication of a uniform porosity cathode. It is also desired to provide a porous cathode structure having uniform porosity where such porosity is invariant through the structure, such that many cathodes of arbitrary thickness may be formed from the structure.

FIG. 2*a* shows two generalized sintering progression curves for sintered copper wires at the copper sintering temperatures 1000° C. and 1050° C., where the progression of sintering is measured by the closing of pores over time as described in "Fundamental Principles of Powder Metallurgy"

by W. D. Jones, Edward Arnold Publishers, London, 1960. The sintering progression is expressed in the metric $$(r_0^3-r^3)/a^3,$$

where $r_0$ is the initial effective radius of the pore r is the effective radius of the pore at time t a is the initial radius of the wire.

The progression of time and temperature reduces the pore size as shown in FIGS. 2*b* through 2*d*. FIG. 2*b* shows the initial condition for time t=0 where the sintered structure 20 comprises a plurality of copper wires 22, with initial pores 24 formed by the spaces between the wires 22. After application of a sintering temperature T such as 1000° C. for copper wires for a time t=T1, the pores 24 begin to close as the wires 22 sinter together, as shown in FIG. 2*c*. At a final time t=T2 shown in FIG. 2*d*, the pores 24 have further closed as the wires sinter together to form a continuous porous structure. By careful selection of sintering time and pressure, the desired porosity may be achieved in the cathode structure 20.

Sintering of copper wires in the prior art has been used principally to develop sintering models and to understand the sintering process for particles, which are treated in the limit as spheres, and has not been used to form continuously porous structures, such as would be used for dispenser cathodes for electron emission.

Devices using electron beams may generate these beams using dispenser cathodes. These porous cathodes are impregnated with material designed to lower the work function at the cathode surface. The cathode is heated to approximately 1000° C. and the impregnate migrates through the pores in the tungsten to the surface. Problems occur when the distribution of pores varies across the cathode surface, leading to nonuniform migration of the impregnate. When this occurs, there is a variation in emission of electrons caused by the variation in work function. This is particularly troublesome for cathodes operating in a regime where the emission is dependent on the temperature. In these circumstances, the emission variation can vary greatly over the surface.

OBJECTS OF THE INVENTION

A first object of the invention is a uniform porosity cathode structure, which may be fabricated from tungsten wire.

A second object of the invention is a method for making a uniform porosity cathode.

A third object of the invention is a porous dispenser cathode.

A fourth object of the invention is a process for making a porous dispenser cathode.

SUMMARY OF THE INVENTION

The present invention describes a technique which allows for controlled, uniform distribution of pores over the entire cathode surface. The technique does not require that the emission material be impregnated, but instead uses a reservoir of work function reducing material below the surface that can provide substantially improved cathode lifetime before the impregnate is depleted. The precise control of both the pore size and uniform electron distribution will allow custom design of the cathode for specific applications.

It is the primary object of the present invention to provide a method for fabricating a dispenser cathode having a uniform surface porosity so that uniform electron emission can be achieved.

To produce a porous matrix the prior art used tungsten powder with a particle size distribution that varied from sub micron diameter particles to particle diameters up to 15 microns. The resultant matrices had pores with varying diameter, length and spacing between pores at the surface. This was the case with either the impregnated matrices or the porous plugs covering a reservoir.

The present invention uses small diameter tungsten wires having a fixed diameter selected from the range of 10 and 20 microns. These fixed diameter wires are sintered together in such a way to produce a porous material with pores which are parallel to the wires and uniformly spaced between the wires. This is accomplished by placing the wires in intimate contact and restrained so that when sintered at temperatures between 2300° C. and 2500° C., a metallurgical phenomenon known as "necking" will fuse the wires together and a series of uniform voids will occur between the contact points. Under natural compaction, these voids will be uniformly spaced around the periphery of the wires every 60 degrees.

The process can be used to control the size of the pores, which can affect the rate of migration of the impregnate, and the distribution of the pores over the surface. The size and distribution of the pores can be optimized based on the application of the cathode to improve the operating characteristics, including the cathode emission density and lifetime.

BRIEF DESCRIPTION OF THE DRAWINGS

FIG. 1 is a perspective view of a prior art cathode fabricated by sintering a powder of tungsten and impregnated with a work function reducing material.

FIG. 2*a* is a graph of pore volume change versus sintering time.

FIG. 2*b* is the section view of a prior art sintered wire structure at initial time t=0.

FIG. 2*c* is the section view of a prior art sintered wire structure at time t=T1.

FIG. 2*d* is the section view of a prior art sintered wire structure at time t=T2.

DETAILED DESCRIPTION OF THE INVENTION

Figure 3A:
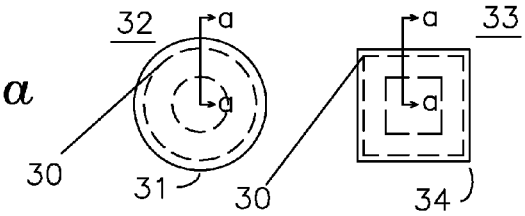
FIG. 3*a* shows a cylindrical and a rectangular spool used to gather wires into a sintering geometry.
Figure 3B:
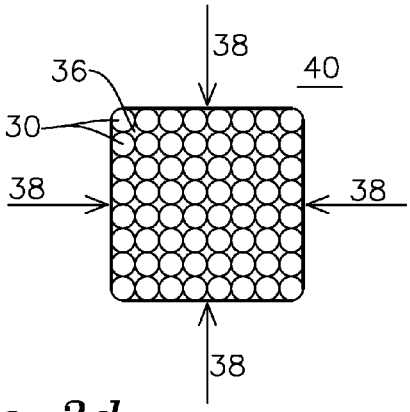
FIG. 3*b* shows a section view of FIG. 3*a* in a sintering structure at initial time t=0.

FIG. 3*a* shows a round bobbin 31 having tungsten wire 30 wound around it, or alternatively a square bobbin 33 having been wound with tungsten wire 30. The wire 30 may be formed from any material or diameter, however it is believed that tungsten wire with a fixed diameter in the range 10-20 u is preferred for porous dispenser cathodes. Tungsten wire in this diameter range is commonly available for use in electro-discharge machining (EDM) and is also used as a source material for fabricating the filament of an incandescent light bulb. When wound about a square 34 or circular 31 bobbin, the cross section a-a of a bundle of such tungsten wires appears as shown in FIG. 3*b*. While the axial wire 30 tension from winding on the bobbin naturally causes a radial confining force, it may be desired to supplement this tensile force with external confining force 38 to enable uniform wire 30 packing during sintering. The porous cathode structure is formed from a plurality of sintered tungsten wires where straight pores of controlled size exist through the structure. The process for manufacturing the material begins with bundles of wires formed on the bobbins of FIG. 3*a*, which are shown in section a-a in FIG. 3*b*. The bundle of tungsten wires 30 are closely packed such that there are uniform gaps, or pores 36 around the periphery of each wire. The length of the wires can be arbitrary and chosen for compatibility with the manufacturing equipment or final application.

Figure 3C:
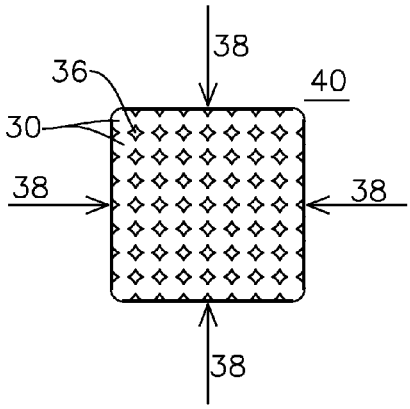
FIG. 3*c* shows the structure of FIG. 3*b* at intermediate time t=T1.
Figure 3D:
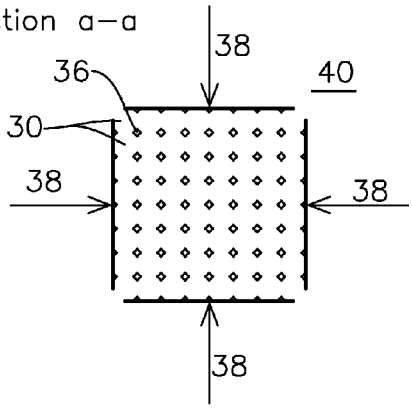
FIG. 3*d* shows the structure of FIG. 3*b* at final time t=T2.
Figure 4:
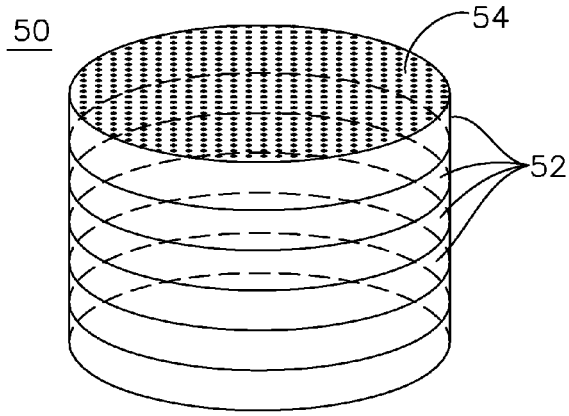
FIG. 4 shows the porous cathode structure of FIG. 3*d* cut into a plurality of sintered wire disks.

FIG. 3*c* shows the intermediate state and FIG. 3*d* shows the final sintered cathode structure 40, and after removal from the bobbin 31 or 34 of FIG. 3*a*, is shown formed in to the cylindrical porous cathode structure 50 of FIG. 4. The resulting sintered cathode structure 50 has a desired porosity based on the tungsten wire diameter as well as the sintering parameters of time and temperature. As shown in FIG. 4, the porous cathode structure 50 may then be cut into several porous cathodes 52, since the pores of the structure run axially through the cathode structure 50. Since the porous cathode is structurally integral, it is possible to separate the individual cathodes 52 using means such as EDM or mechanical cutting. The ease of separating these cathode disks 52 stands in contrast to prior art bulk cathodes sintered from particles of tungsten, where the prior art sintered particle cathode requires copper infusion into the pores to provide sufficient mechanical strength for any subsequent machining operations. The integral structure of sintered tungsten 50 provides internal mechanical strength to allow machining operations directly on the porous cathode structure 50, and the resulting individual porous cathodes 52 may be machined to create an electron emission surface which is planar, concave, or any shape desired from the prior art of cathode emission surface profiles.

Figure 5A:
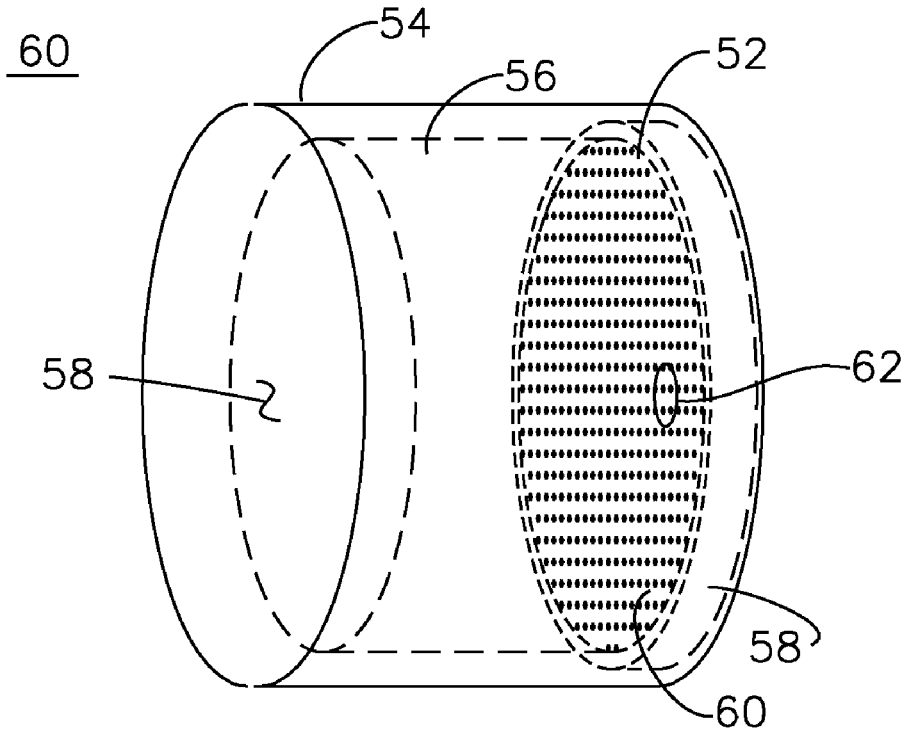
FIG. 5*a* shows a perspective view of a sintered wire cathode assembly.
Figure 5B:
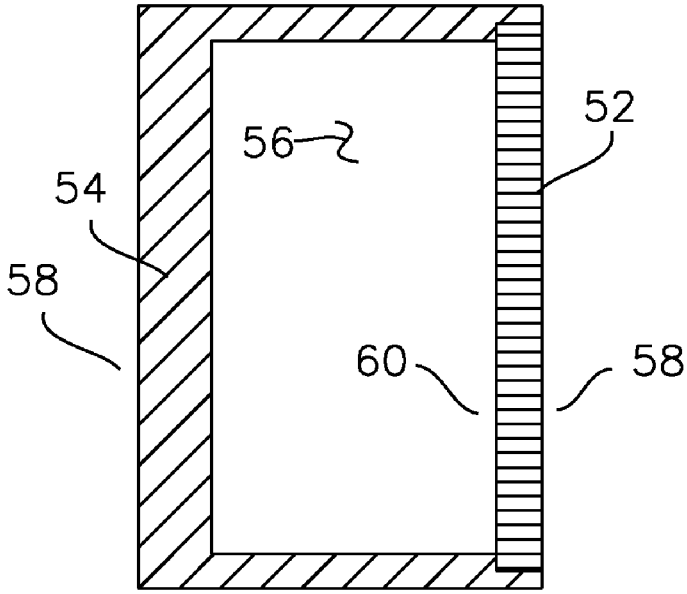
FIG. 5*b* shows a section view of the sintered wire cathode assembly of FIG. 5*a*.

FIG. 5*a* shows a dispenser cathode assembly 60 including a porous cathode 52 fabricated according to the present invention. The porous cathode 52 is cut from the cathode structure of FIG. 4, and is placed in dispenser cathode support 54, which also has formed a cavity 56 for enclosing a work function reducing material (not shown), which may be any of the known work function reducing materials BaO, CaO, and $Al_2O_3$, or any alternate material known to reduce the free electron work function for an electron emitting cathode 52. FIG. 5*b* shows a section view of the cathode of FIG. 5*a*. Porous cathode 52 has an electron emission surface 58 and a work function replenishment surface 60. The dispenser cathode support 54 is placed adjacent to a heat source on surface 58 which heats the porous cathode 52 and causes migration of the BaO, CaO, and $Al_2O_3$ mixture in cavity 56 through cathode 52 pores 62 to the emitting surface 58 where electrons are emitted when an accelerating potential (not shown) is applied to the dispenser cathode assembly 60. The uniform distribution of pores 62 provides uniform distribution of the impregnate over the emission surface 58. The emission surface 58 may be planar or concave, or any shape known in the art of cathode emission surfaces.

Many variations of the invention may be practiced within the scope of the specification herein. For example, the porous cathode may be fabricated from alternate materials other than tungsten, and a heterogeneous mixture of wire diameters may be concurrently wound to produce a variety of pore spacings and patterns. Any of the refractory metals used in cathode prior art may be formed into wires which can then be sintered into a cathode structure as described in the present invention. In the prior art of powdered sintered cathodes, the work function material was placed in the sintered matrix. In the present invention, the work function material may be coated on the wire prior to sintering, such that the work function material is loaded into the cathode after sintering, or as described in the drawings, the work function material may be placed in a cavity behind the electron emission surface of the porous cathode 52, as shown in FIGS. 5*a* and 5*b*.

We claim:

1. A cathode for electron emission, said cathode having:

a porous cathode formed from a plurality of continuous wires having linear regions, said wires joined to each other by partially melting said wires along said linear regions substantially coaxial to said wires, said partial melting thereby forming substantially continuous and linear pores adjacent to said melted linear regions, said porous cathode having an emission surface and a replenishment surface, said linear pores coupling said emission surface to said replenishment surface;

a dispenser cathode support including a cavity adjacent to said porous cathode replenishment surface, said cavity containing a work function lowering material and allowing said work function lowering material to travel from said cavity to said emission surface using said pores.

2. The cathode of claim 1 where said work function lowering material in said cavity includes at least one of BaO, CaO, and $Al_2O_3$.

3. The cathode of claim 1 where said porous cathode emission surface is planar.

4. The cathode of claim 1 where said porous cathode emission surface is concave.

5. The cathode of claim 1 where said wires are tungsten.

6. The cathode of claim 5 where said tungsten wires have a diameter prior to sintering of 10 u to 20 u.

7. The cathode of claim 1 where said wires are a refractory metal.

8. The cathode of claim 1 where said wires have substantially equal diameters.

9. The cathode of claim 1 where at least one said wire is formed from a different refractory metal.

10. The cathode of claim 1 where said work function lowering material increases the thermionic emission of free electrons.

11. The cathode of claim 1 where said sintered wires are coated with said work function lowering material prior to sintering, and said pores are thereby substantially filled with said work function lowering material.

12. A porous cathode having:

a plurality of wires partially melted to each other and thereby forming linear and substantially continuous pores adjacent to each said partially melted wire, said porous cathode having a replenishment surface and an opposing emission surface, said replenishment surface and said emission surface coupled to each other by said substantially continuous pores, said pores supporting a work function lowering material.

13. The porous cathode of claim 12 where said work function lowering material moves through said pores to said emission surface as either said wires or said work function lowering material of said emission surface is consumed.

14. The porous cathode of claim 13 where the movement of said work function lowering material through said pores is the result of capillary action.

15. The porous cathode of claim 12 where said work function lowering material contains at least one of BaO, CaO, or $Al_2O_3$.

16. The porous cathode of claim 12 where said work function lowering material is introduced into said pores after sintering of said wires.

17. The porous cathode of claim 12 where said work function lowering material is coated on said wires before said sintering, said sintering causing said work function lowering material to substantially fill said pores.

18. A porous cylinder formed from a plurality of substantially linearly arranged wires partially melted to each other along substantially linear regions of adjacent contact of said wires, said partial melting such as by sintering, whereby regions of said wires which are not melted to each other form pores which are substantially continuous along said wires, said porous cylinder having a replenishment surface and an opposing emission surface coupled to said replenishment surface by said substantially continuous pores.

19. The porous cylinder of claim 18 where said substantially continuous pores contain a work function lowering material.

20. The porous cylinder of claim 18 where said porous cylinder includes a reservoir for the storage of a work function lowering material, said reservoir coupled to said replenishment surface which is also coupled to said emission surface through said pores.

21. The porous cylinder of claim 19 where said work function lowering material is at least one of BaO, CaO, or $Al_2O_3$.

22. The porous cylinder of claim 18 where said wires are tungsten and have diameters in the range 10 u to 20 u.

* * * * *